US007971577B2

(12) United States Patent
Styles et al.

(10) Patent No.: US 7,971,577 B2
(45) Date of Patent: Jul. 5, 2011

(54) EGR COOLER DEFOULING

(75) Inventors: Daniel Joseph Styles, Canton, MI (US); David Curtis Ives, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 399 days.

(21) Appl. No.: 12/205,472

(22) Filed: Sep. 5, 2008

(65) Prior Publication Data

US 2010/0058748 A1 Mar. 11, 2010

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.11, 563; 701/108; 60/310, 605.2, 60/278, 279, 280
See application file for complete search history.

(56) References Cited

U.S. PATENT DOCUMENTS

| | | | | |
|---|---|---|---|---|
| 5,546,915 | A | 8/1996 | Isobe | |
| 5,669,365 | A * | 9/1997 | Gartner et al. | 123/568.12 |
| 6,474,060 | B2 * | 11/2002 | Khair | 60/275 |
| 6,474,319 | B1 * | 11/2002 | Hough et al. | 123/568.11 |
| 6,826,903 | B2 | 12/2004 | Yahata et al. | |
| 6,848,434 | B2 | 2/2005 | Li et al. | |
| 6,904,898 | B1 * | 6/2005 | Sahlen | 123/568.12 |
| 6,971,364 | B2 | 12/2005 | Pilgram et al. | |
| 7,284,544 | B2 | 10/2007 | Hatano | |
| 7,461,641 | B1 * | 12/2008 | Styles et al. | 123/568.12 |
| 2006/0272625 | A1 | 12/2006 | Wang | |

* cited by examiner

*Primary Examiner* — Mahmoud Gimie
(74) *Attorney, Agent, or Firm* — Julia Voutyras; Alleman Hall McCoy Russell & Tuttle LLP

(57) ABSTRACT

A method to dislodge an adherent residue in an EGR cooler, the EGR cooler installed in an engine. The method comprises switchably flowing the exhaust gas through the exhaust-gas recirculation cooler according to a normal-calibration control mode when a temperature of the coolant is above a threshold temperature, and switchably flowing the exhaust gas through the exhaust-gas recirculation cooler according to an EGR-cooler restoring control mode (with a greater time-averaged flow of the exhaust gas) when the temperature of the coolant is below the threshold temperature.

17 Claims, 5 Drawing Sheets

EGR COOLER DEFOULING

TECHNICAL FIELD

The present application relates to the field of emissions control in internal combustion engines, and more particularly, to exhaust-gas recirculation systems.

BACKGROUND AND SUMMARY

Some internal-combustion engines use an exhaust-gas recirculation (EGR) system to limit nitrogen oxide (NOX) emissions and provide other advantages. In such engines, some of the exhaust gas released from a combustion chamber during an exhaust stroke is fed back into the combustion chamber during a subsequent intake stroke. By diluting intake air with exhaust gas, the EGR system lowers the peak combustion temperature in the combustion chamber, thereby reducing the rate of NOX formation therein. Further, EGR reduces the concentration of oxygen in the exhaust stream, which may increase the efficiency of some exhaust-aftertreatment devices, particularly those used in diesel engines.

An EGR system may include an EGR cooler—a heat exchanger configured to reduce the temperature of the exhaust gas before it re-enters the combustion chamber. Some EGR coolers comprise a flow tube through which heat from the exhaust is transferred to a coolant fluid, e.g. the engine coolant. With continued use, however, the EGR cooler may be subject to fouling. In particular, adherent residues accumulated inside the flow tube—products of incomplete combustion, soot, etc.—may reduce the efficiency of the EGR cooler by limiting heat transfer. More significant accumulation of adherent residues may restrict gas flow through the EGR system. Either or both of these conditions may lead to combustion-control difficulties, increased engine pumping work, and ultimately to increased NOX emissions.

One remedy for the problem of EGR cooler fouling is to periodically disassemble the EGR system and clean the flow tube mechanically, or with the aid of solvents, detergents, etc. The disadvantage here is increased maintenance cost for the engine system.

Another approach is described in U.S. Pat. No. 6,826,903. Here, degraded EGR cooler performance is detected when intake pressure falls below a predetermined value. When degraded EGR cooler performance is detected, the temperature inside the EGR cooler is increased by heating the exhaust gas to eliminate soot or unburned hydrocarbons by oxidation. A related approach is described in U.S. Pat. No. 7,284,544, wherein hot exhaust gas is used to burn off adherent residues accumulated elsewhere in the EGR system.

However, under some conditions, the high-temperature oxidation approaches cited above may use increased amounts of heat-resistant components, modified valve timings to provide exhaust gas heating, and additional electronically controlled valves—in coolant flow paths, for example. Alternatively, without such additional measures, cooler degradation may occur more readily due to increased oxidation at high-temperatures.

The inventors herein have recognized these disadvantages and have devised an approach to at least partially address EGR cooler fouling. Thus, one embodiment provides a method to dislodge an adherent residue in an EGR cooler, the EGR cooler installed in an engine. The method comprises flowing an exhaust gas through an adherent-residue bearing surface of the EGR cooler when a temperature of the adherent-residue bearing surface is below a dewpoint temperature of the exhaust gas, enabling water vapor from the exhaust gas to condense on the adherent-residue bearing surface, heating the adherent-residue bearing surface to above the dewpoint temperature of the exhaust gas, and enabling condensed water on the adherent-residue bearing surface to evaporate. Other embodiments provide methods to recirculate an exhaust gas from an exhaust port of an engine to an intake of the engine via an EGR cooler, and related EGR systems, for example.

Specifically, the inventors herein have recognized that water condensation at lower temperatures, such as during cold start operation, may interact with an adherent residue in an EGR cooler, and when the condensed water later evaporates, at least some of the adherent residue may be released, without requiring temperatures high enough to oxidize the adherent residue. However, in some embodiments, the above approach may be combined with high-temperature removal of adherent residue in the EGR cooler, if desired.

It should be understood that the summary above is provided to introduce in simplified form a selection of concepts that are further described in the Detailed Description. It is not meant to identify key or essential features of the claimed subject matter, the scope of which is defined uniquely by the claims that follow the Detailed Description. Further, the claimed subject matter is not limited to implementations that solve any disadvantages noted above or in any part of this disclosure.

DETAILED DESCRIPTION

Figure 1:
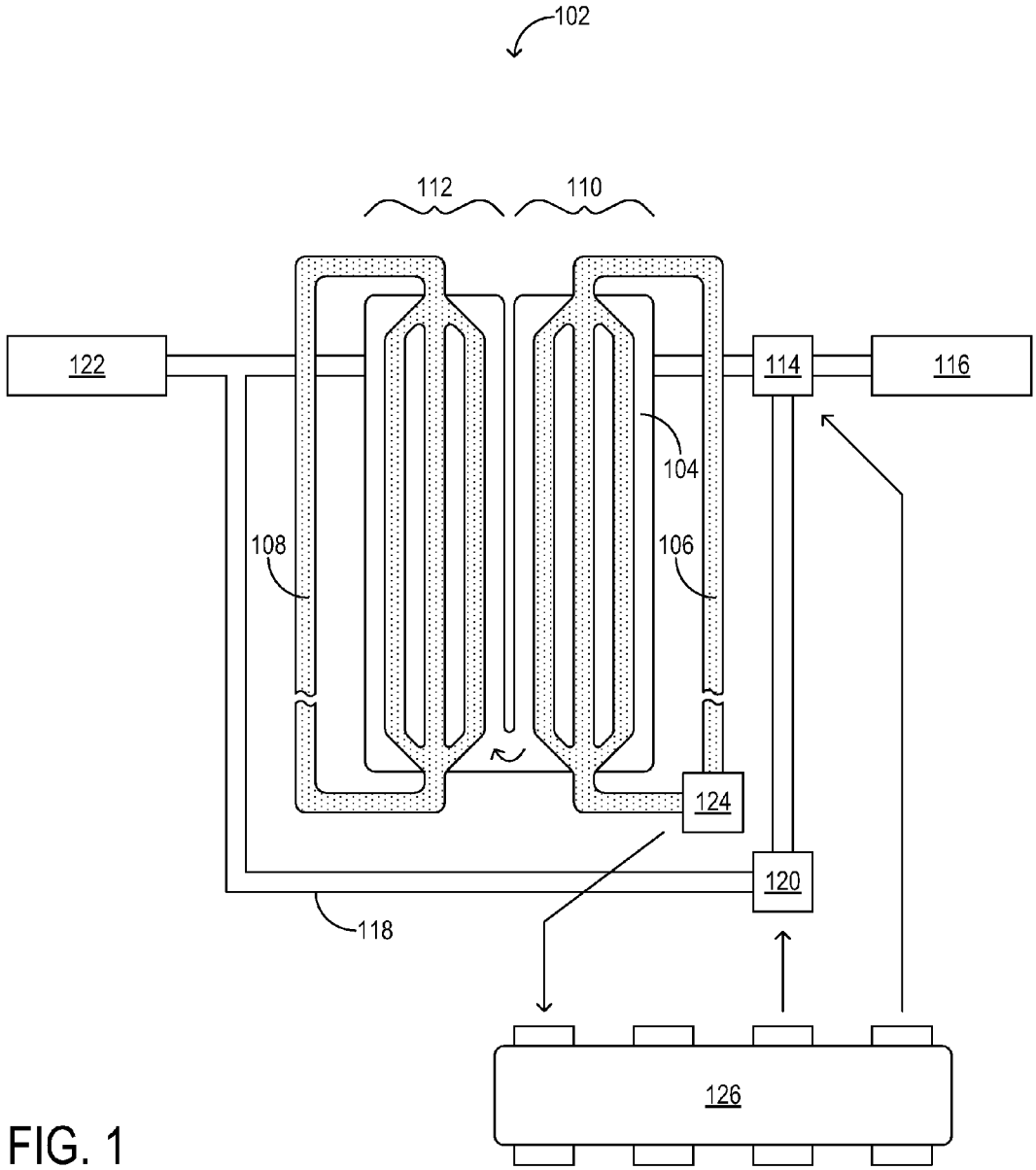
FIG. 1 shows an example EGR system in accordance with the present disclosure.

FIG. 1 shows an example EGR system. The EGR system includes EGR cooler 102, which is configured to transmit heat from exhaust gas 104 to first coolant 106 and to second coolant 108. In the illustrated embodiment, heat from the exhaust gas is transferred to the first coolant via first heat exchanger 110, and to the second coolant via second heat exchanger 112, where the exhaust gas, the first coolant, and the second coolant flow in separate, thermally communicating but fluidically non-communicating passageways. In one example, the EGR system may be installed in an engine, the first coolant may be a recirculating engine coolant, and the second coolant may be a recirculating or non-recirculating auxiliary coolant.

The coolant flow paths represented in FIG. 1 may include other components not shown in the drawing. For example, first coolant 106 may be conducted through a radiator, a water pump, and/or a cooling jacket of the engine. Likewise, second coolant 108 may be conducted through a radiator, a pump, and/or a heat exchanger, as examples. In one example, second coolant 108 may circulate through other coolers, such as an intake charge air cooler configured to cool intake air down-stream of a turbocharger compressor in the intake manifold, in an example where the engine is a turbocharged engine.

In some embodiments, first coolant 106 and second coolant 108 may have different operating-temperature ranges, so that exhaust gas passing through EGR cooler 102 is cooled in two discrete stages. For example, the first coolant may be a relatively high temperature coolant, e.g. −5 to 95° C., and the second coolant may be a relatively low-temperature coolant, e.g. −5 to 45° C. It will be understood that the example temperature ranges cited above are exemplary, and other temperature ranges are contemplated as well.

In another embodiment, the first coolant and/or the second coolant may be fresh air drawn through or around the EGR cooler. Further, it should be understood that while FIG. 1 shows two different coolant paths and two different heat exchangers, other embodiments fully consistent with this disclosure may include only one coolant path and one heat exchanger.

FIG. 1 shows EGR main valve 114 coupled to exhaust manifold 116, EGR cooler by-pass conduit 118, and EGR-cooler by-pass valve 120. The EGR main valve is configured to switchably admit the exhaust gas to EGR cooler 102 and to EGR cooler by-pass conduit 118. In particular, the exhaust gas may flow through the EGR cooler by-pass conduit when EGR-cooler by-pass valve 120 is open. In the illustrated embodiment, exhaust from the EGR cooler and from the EGR cooler by-pass conduit are both routed to intake manifold 122.

FIG. 1 shows temperature sensor 124 and controller 126. The temperature sensor may be responsive to a temperature of coolant 106. The controller may be operatively coupled to the temperature sensor, to the EGR main valve, and to the EGR-cooler by-pass valve. In one embodiment, the controller is configured to actuate the EGR main valve and/or the EGR-cooler by-pass valve to admit the exhaust gas to the EGR cooler at least when the temperature of the first coolant is below a threshold temperature. In other embodiments, the EGR main valve and the EGR-cooler by-pass valve may be among a plurality of valves actuated by the controller to switchably admit the exhaust gas to the EGR cooler at least when the temperature of the first coolant is below the threshold temperature.

An EGR system as illustrated in FIG. 1 may be installed in an engine. During prolonged operation of the engine, the EGR cooler may become fouled, e.g., an adherent soot- and/or hydrocarbon-containing residue may accumulate inside the EGR cooler. Therefore, the balance of this disclosure provides example methods to dislodge an adherent residue in an EGR cooler, and related methods to recirculate an exhaust gas from an exhaust port of an engine to an intake of the engine via the EGR cooler.

Figure 2:
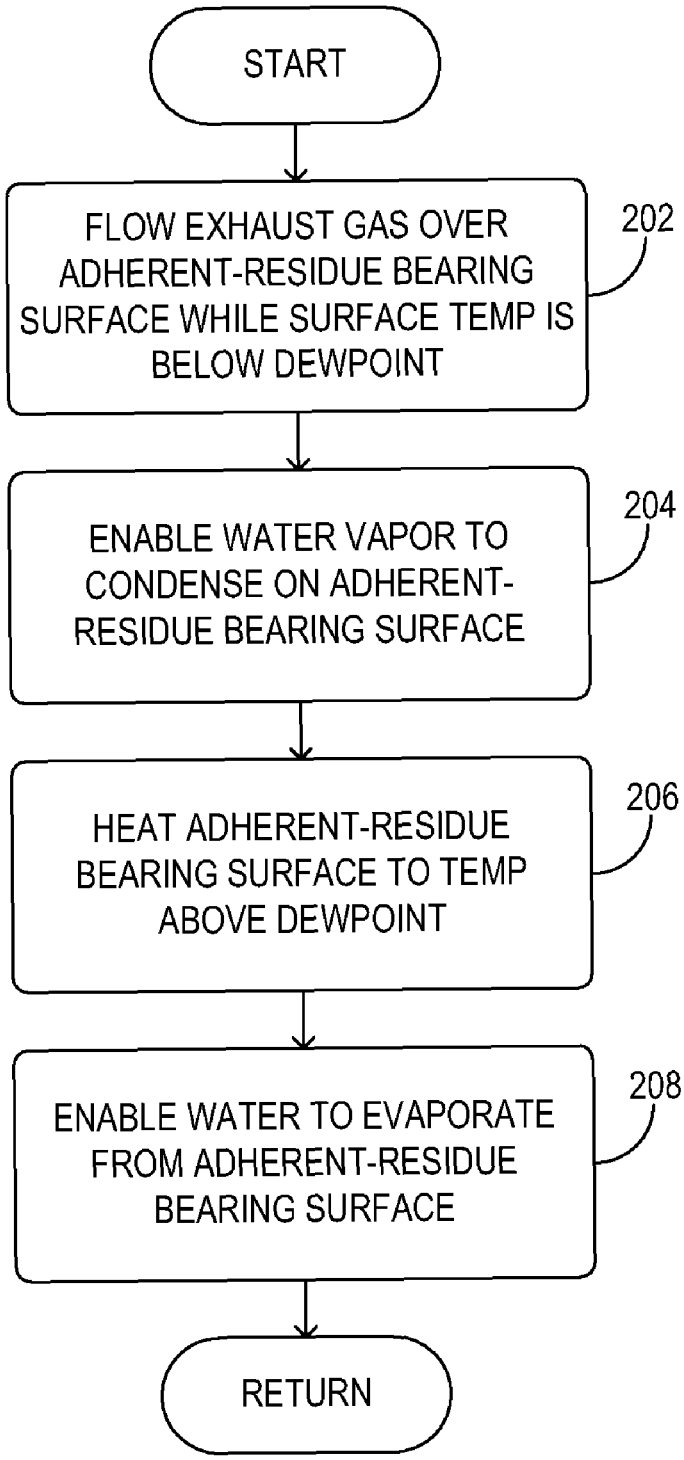
FIG. 2 illustrates, by way of a flow chart, an example method to dislodge an adherent residue in an EGR cooler, in accordance with the present disclosure.

FIG. 2 illustrates, by way of a flow chart, an example method to dislodge an adherent residue in an EGR cooler, the EGR cooler installed in an engine, e.g., a diesel engine. The method begins at 202, where an exhaust gas is flowed over an adherent-residue bearing surface of the EGR cooler when a temperature of the surface is below a dewpoint temperature of the exhaust gas.

It will be understood that the term 'dewpoint temperature of the exhaust gas' is used herein to refer to the temperature at which the partial pressure of water vapor in the exhaust gas is equal to the saturated vapor pressure of water. The dewpoint temperature of the exhaust gas will thus vary with the partial pressure of water-vapor in the exhaust gas, becoming greater with increasing partial pressure of water-vapor.

The adherent-residue bearing surface may be an inside surface of the EGR cooler; it may have accumulated an adherent residue by prolonged passage of exhaust gas through the EGR cooler during normal engine operation. The adherent residue may include a soot and/or a hydrocarbon, as examples.

In one embodiment, the coolant may be an engine coolant. The adherent-residue bearing surface of the EGR cooler may be colder than the dewpoint temperature of the exhaust gas because of a transient low temperature of a coolant flowing through or around the EGR cooler, such as a low temperature at engine start-up. In some embodiments, where a low-temperature coolant flows behind or around the adherent-residue bearing surface, and where the surface is made of a thin layer of thermally conductive material, the temperature of the surface may closely approach that of the coolant.

When the exhaust gas contacts the adherent-residue bearing surface, water vapor from the exhaust gas may have a tendency to condense thereon. Thus, at 204, condensation of water vapor on the adherent-residue bearing surface is enabled. The condensation may be enabled as a result of sufficient residence time being provided for the exhaust gas to contact the adherent-residue bearing surface (by appropriate configuration of the surface area, flow rate of the exhaust gas, etc.) If the surface is to any degree porous and to any degree wettable by water, some of the condensed water may wick into and be absorbed by the adherent residue. If the adherent residue is to any degree soluble or dispersible in water, then some of the adherent residue may wash down the adherent residue-bearing surface. Thus, one embodiment further comprises enabling at least some of the adherent residue to wash off the adherent-residue bearing surface when water vapor condenses on the adherent-residue bearing surface.

The example method continues to 206, where the adherent-residue bearing surface of the EGR cooler is heated to above the dewpoint temperature of the exhaust gas. The surface may be heated by continued passage of exhaust gas through the EGR cooler and/or by an increase in coolant temperature. In one embodiment, where the coolant is an engine coolant, continued operation of the engine may cause the temperature of the engine coolant, and therefore the surface (vide supra) to warm to above the dewpoint temperature of the exhaust gas.

When the temperature of the surface is above the dewpoint temperature of the exhaust gas, water absorbed in the adherent residue may have a tendency to evaporate therefrom. Thus, at 208, evaporation of water from the adherent-residue bearing surface is enabled. Evaporation may be enabled via appropriate control of the pressure inside the EGR cooler, for example. In some examples, expansive evaporation of the water may dislodge at least some of the adherent residue from the adherent-residue bearing surface. The residue thereby dislodged may then be carried through to the engine intake or otherwise collected in a part of the EGR cooler that is substantially outside of the flow path to the engine intake. Thus, one embodiment further comprises enabling at least some of the adherent residue to dislodge from the adherent-residue bearing surface when the condensed water evaporates.

Figure 3:
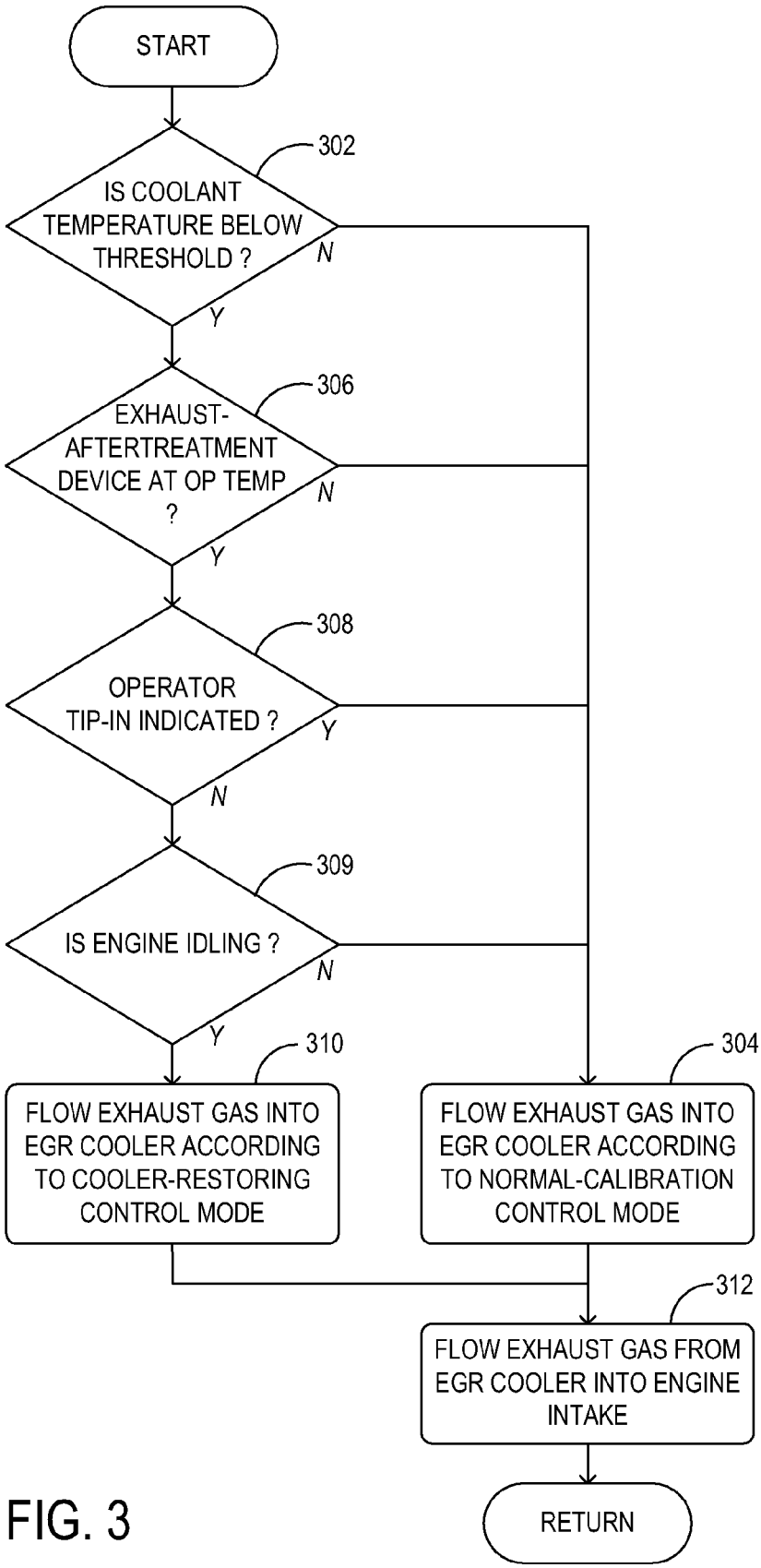
FIG. 3 illustrates, by way of a flow chart, an example method to recirculate an exhaust gas from an exhaust port of an engine to an intake of the engine via an EGR cooler, in accordance with the present disclosure.

FIG. 3 illustrates an example method to recirculate an exhaust gas from an exhaust port of an engine to an intake of the engine via an EGR cooler, the engine and the EGR cooler sharing a coolant, the exhaust port coupled to an exhaust system. The process flow may be initiated at engine start-up, for example.

At 302, it is determined whether the coolant temperature is below a threshold temperature. The threshold temperature may be selected based on a determined or predicted dewpoint temperature of the exhaust gas. In some embodiments, it may be substantially the same, slightly lower, or lower than the determined or predicted dewpoint temperature of the exhaust gas. In other embodiments, the dewpoint temperature of the exhaust gas may be altered—and the amount of condensable water vapor increased—by injecting water into the engine intake.

Continuing, if the temperature of the coolant is not below the threshold temperature, then at 304, the exhaust gas is switchably flowed through the EGR cooler or by-passed around the EGR cooler according to a normal-calibration control mode, wherein the normal-calibration control mode is configured to balance emissions, fuel economy, and engine performance. In some embodiments, the normal-calibration control mode may include a control routine wherein a main EGR valve is held closed until an engine coolant temperature approaches a normal operating temperature of the engine coolant, and, wherein the main EGR valve and an EGR-cooler by-pass valve are controlled thereafter to maintain one or more desired engine operating conditions—exhaust temperature, exhaust-stream oxygen concentration, engine torque, as examples—in a manner that limits engine emissions and brake-specific fuel consumption.

Figure 4:
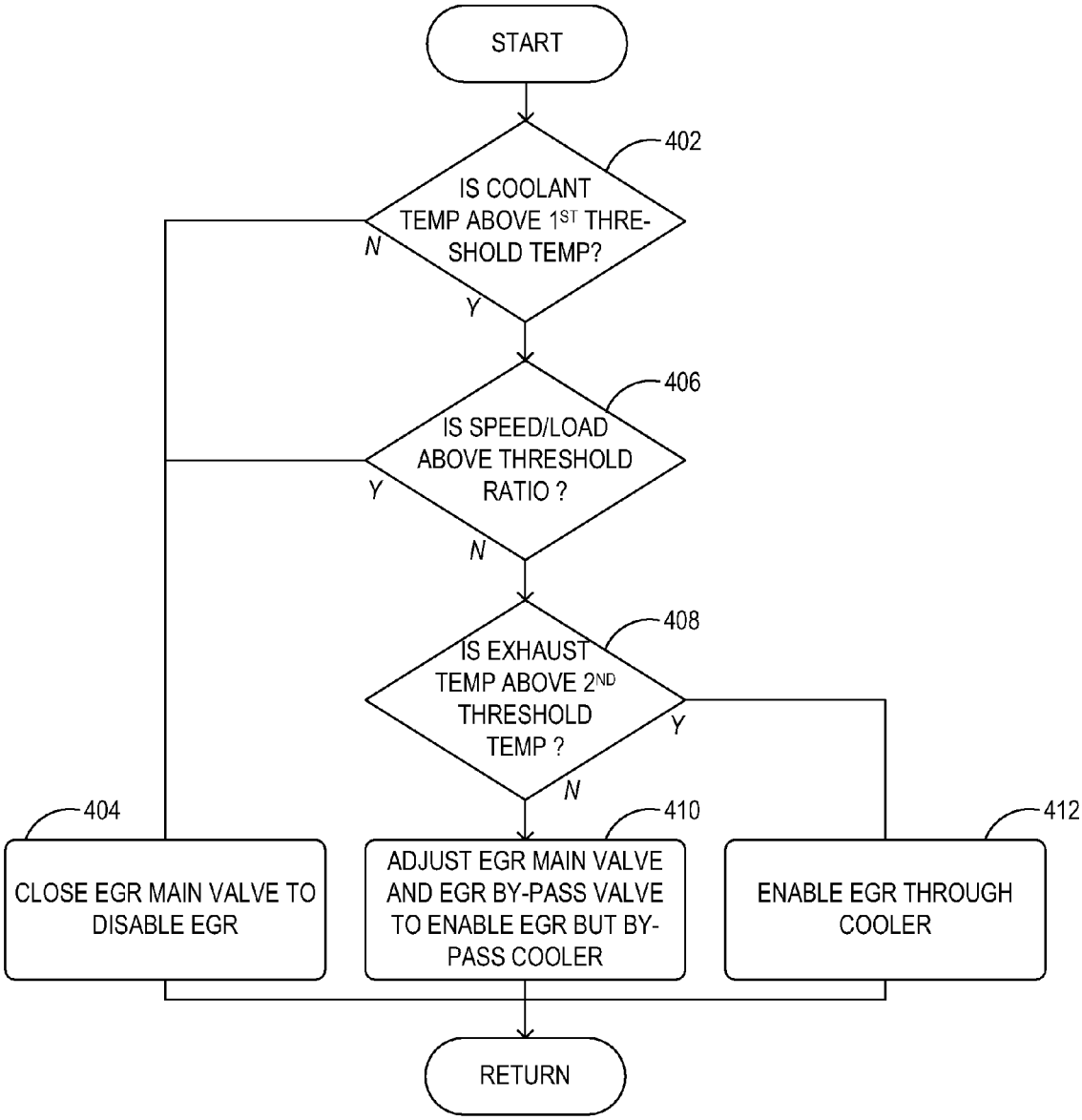
FIG. 4 illustrates, by way of a flow chart, an example normal-calibration control mode, in accordance with the present disclosure.

FIG. 4 illustrates a normal-calibration control mode in one, example embodiment. The process begins at 402, where it is determined whether a coolant temperature is above a first threshold temperature. If the coolant temperature is not above the first threshold temperature, then at 404, the EGR main valve is closed to disable exhaust-gas recirculation. However, if the coolant temperature is above the first threshold temperature, the process continues to 406, where it is determined whether the engine's speed-to-load ratio is above a predetermined threshold ratio. If the speed-to-load ratio is above the threshold ratio, then the process reverts to 404. Otherwise, the process continues to 408, where it is determined whether an exhaust temperature is above a second threshold temperature. If the exhaust temperature is not above the second threshold temperature, then the EGR main valve and an EGR by-pass valve are adjusted, at 410, to enable exhaust-gas recirculation, but without cooling of the exhaust stream. However, if the exhaust temperature is above the second threshold temperature, then the EGR main valve and the EGR by-pass valve are adjusted, at 412, to route exhaust gas through the EGR cooler and into the engine intake.

In other embodiments, different process steps may be included. For instance, the normal-calibration control mode may further include a control routine wherein the EGR cooler is bypassed until an exhaust-aftertreatment device in the exhaust system (a three-way catalytic converter, lean NOX trap, diesel oxidation catalyst, etc.) has reached an efficient operating temperature.

Returning now to FIG. 3, if the coolant temperature is below the threshold temperature, then at 306, it is judged whether an exhaust-aftertreatment device as described above has reached an efficient operating temperature. If the exhaust-aftertreatment device has not reached an efficient operating temperature, then the process reverts to 304. Otherwise, the process continues to 308, where it is determined whether an operator tip-in is indicated.

Operator tip-in is one example in which a relatively high torque demand is placed on the engine, so that opening the EGR passage may be disabled. Other examples are contemplated as well; these include gear changes and/or driver gear engagement from neutral, and others. Thus, if an operator tip-in is indicated, or more generally, if torque demand increases above a threshold torque, then the process again reverts to 304. Otherwise, it continues to 309, where it is determined whether the engine is idling. If the engine is not idling, then the process again reverts to 304, but, if the engine is idling, it continues to 310.

At 310, exhaust gas is switchably flowed into the EGR cooler according to an EGR-cooler restoring control mode, the EGR-cooler restoring control mode configured to condense water vapor from the exhaust gas inside the EGR cooler.

Figure 5:
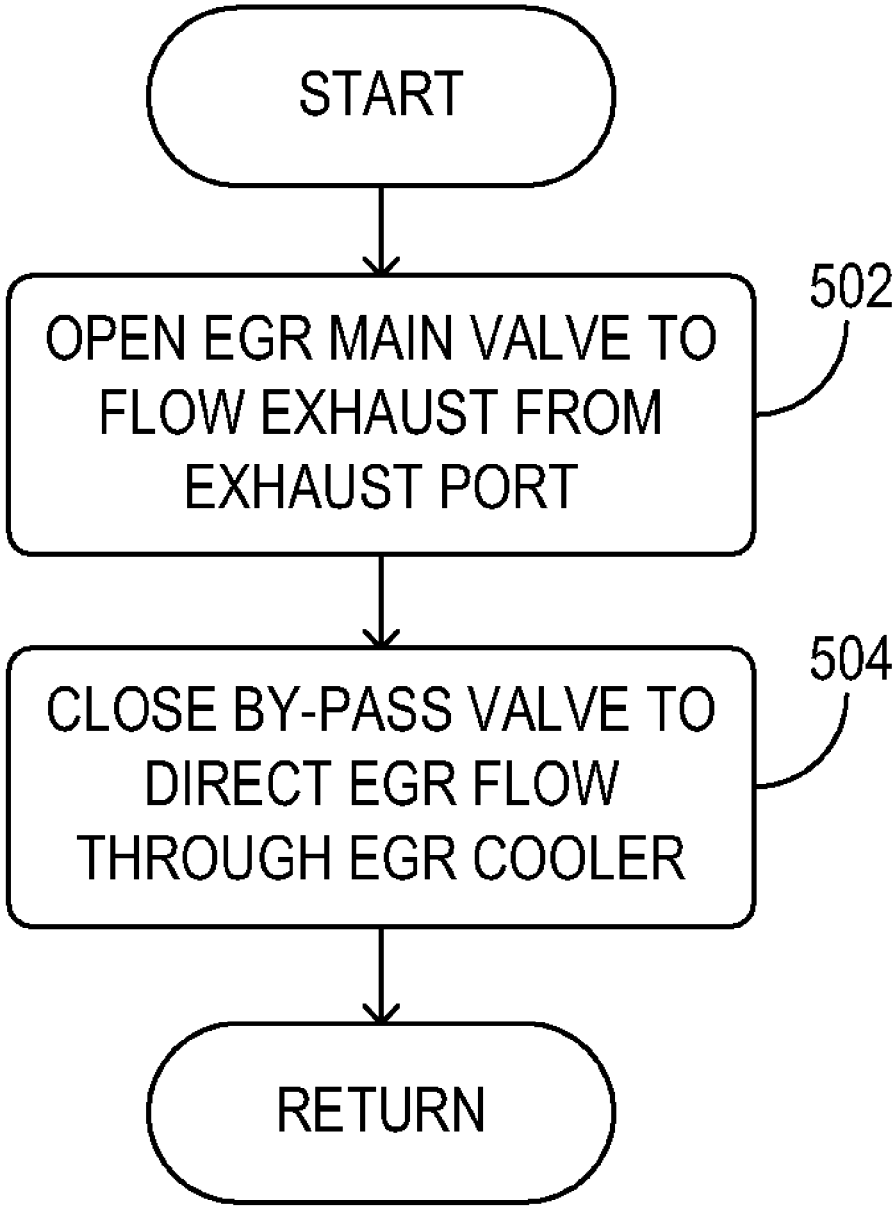
FIG. 5 illustrates, by way of a flow chart, an example EGR-cooler restoring control mode, in accordance with the present disclosure.

FIG. 5 illustrates an EGR-cooler restoring control mode in one, example embodiment. The process begins at 502, where an EGR main valve is opened to admit a flow of exhaust from an exhaust port of the engine. It continues to 504, where an EGR by-pass valve is closed to force the entire EGR flow through the EGR cooler.

Thus, the EGR-cooler restoring control mode may admit a greater time-averaged flow of exhaust gas through the EGR cooler when the temperature of the coolant is below the threshold temperature than does the normal-calibration control mode. In the illustrated embodiment, switchably flowing the exhaust gas through the EGR cooler according to an EGR-cooler restoring control mode includes flowing the exhaust gas continuously through the EGR cooler. In other embodiments, the flow of exhaust gas through the EGR cooler during EGR-cooler restoring control mode may be interrupted, i.e., discontinuous, but still may admit a greater time-averaged flow of exhaust gas through the EGR cooler when the temperature of the coolant is below the threshold temperature than does the normal-calibration control mode.

In still other embodiments, the EGR-cooler restoring control mode may be a control mode adapted or inherited from the normal-calibration control mode, but including a phase where exhaust gas is passed through the EGR cooler when the coolant temperature is below a threshold temperature. In one embodiment, such a phase may begin at engine startup, when the engine coolant is cold, and may continue until the engine coolant temperature has exceeded the threshold temperature. As noted above, the threshold temperature may be selected based on the determined or predicted dewpoint temperature of the exhaust gas. In some embodiments, it may be substantially the same, lower, or slightly lower than the determined or predicted dewpoint temperature of the exhaust gas, so that passing the exhaust gas through the EGR cooler results in condensation of water vapor inside the EGR cooler.

Returning again to FIG. 3, at 312, exhaust gas from the EGR cooler is flowed into the intake of the engine.

In the illustrated embodiment of FIG. 3, exhaust gas is switchably flowed through the EGR cooler according to the EGR-cooler restoring control mode only after the exhaust-aftertreatment device disposed within the exhaust system has reached an efficient operating temperature, when a torque demand on the engine is below a threshold torque, and, when the engine is idling. In other embodiments, however, the EGR-cooler restoring control mode may be used when the coolant is below the threshold temperature irrespective of torque demand, idle state, and/or exhaust-aftertreatment device temperature.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in a control system, e.g. controller 126, represented in FIG. 1.

Thus, controller 126 may be configured, by actuating one or more valves and interrogating one or more sensors, to switchably admit exhaust gas to an EGR cooler according to a normal-calibration control mode when a temperature of the coolant is above a threshold temperature, and, to switchably admit the exhaust gas to the EGR cooler according to a EGR-cooler restoring control mode when a temperature of the coolant is below the threshold temperature, the EGR-cooler restoring control mode admitting a greater time-averaged flow of the exhaust gas through the EGR cooler when the temperature of the coolant is below the threshold temperature than does the normal-calibration control mode.

In one example, controller 126 may be further configured to switchably admit the exhaust gas to the EGR cooler according to an EGR-cooler restoring control mode immediately following and/or during a cold start of the engine. In another example, the controller may be further configured, based on a control-mode schedule or sequence, to switchably admit the exhaust gas to the EGR cooler according to an EGR-cooler restoring control mode following some cold starts of the engine and according to the normal-calibration control mode following other cold starts of the engine. Further, the controller may be further configured to vary the control-mode schedule or sequence based on an accumulated run time of the engine.

It is further contemplated that some engine systems may enable condensation-based EGR cooler defouling, as described hereinabove, as well as high-temperature oxidative defouling. Controllers in such engine systems may be configured to schedule defouling sequences of both kinds intermittently. For example, the routine may perform condensation-based defouling after every cold start (but not after warm re-starts), and may periodically perform high-temperature oxidative defouling less frequently-based on a pressure drop in the EGR system, a NOX emission, a fuel consumption, accumulated engine run time, etc.

It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it should be understood that the systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A method to recirculate an exhaust gas from an exhaust port of an engine to an intake of the engine via an exhaust-gas recirculation cooler, the engine and the exhaust-gas recirculation cooler sharing a coolant, the exhaust port coupled to an exhaust system, the method comprising:

when a temperature of the coolant is above a threshold temperature, switchably flowing the exhaust gas through the exhaust-gas recirculation cooler according to a normal-calibration control mode;

when a temperature of the coolant is below the threshold temperature, switchably flowing the exhaust gas through the exhaust-gas recirculation cooler according to an EGR-cooler restoring control mode, the EGR-cooler restoring control mode admitting a greater time-averaged flow of the exhaust gas through the exhaust-gas recirculation cooler when the temperature of the coolant is below the threshold temperature than does the normal-calibration control mode; and flowing the exhaust gas from the exhaust-gas recirculation cooler to the intake of the engine.

2. The method of claim 1, wherein switchably flowing the exhaust gas through the exhaust-gas recirculation cooler according to an EGR-cooler restoring control mode includes flowing the exhaust gas continuously through the exhaust-gas recirculation cooler.

3. The method of claim 1, wherein the threshold temperature is lower than a determined or predicted dewpoint temperature of the exhaust gas.

4. The method of claim 1, wherein the exhaust-gas is switchably flowed through the exhaust-gas recirculation cooler according to an EGR-cooler restoring control mode only after an exhaust-aftertreatment device disposed within the exhaust system has reached an efficient operating temperature.

5. The method of claim 1, further comprising determining a torque demand on the engine, and switchably flowing the exhaust gas through the exhaust-gas recirculation cooler according to the EGR-cooler restoring control mode only when the torque demand is below a threshold torque.

6. The method of claim 5, wherein determining a torque demand includes determining whether an operator tip-in is occurring, and flowing the exhaust gas through the exhaust-gas recirculation cooler according to the EGR-cooler restoring control mode only when the operator tip-in is not occurring.

7. The method of claim 1, wherein the exhaust gas is switchably flowed through the exhaust-gas recirculation cooler according to an EGR-cooler restoring control mode immediately following a cold start of the engine.

8. The method of claim 1, further including injecting water into the intake of the engine.

9. An exhaust-gas recirculation system, comprising:

an exhaust-gas recirculation cooler configured to transmit heat from an exhaust gas to a first coolant;

a valve configured to switchably admit the exhaust gas to the exhaust-gas recirculation cooler;

a temperature sensor responsive to a temperature of the first coolant;

a controller operatively coupled to the temperature sensor and to the valve, and configured to actuate the valve to switchably admit the exhaust gas to the exhaust-gas recirculation cooler at least when the temperature of the first coolant is below a threshold temperature, wherein the controller is further configured to switchably admit the exhaust gas to the exhaust-gas recirculation cooler according to a normal-calibration control mode when a temperature of the coolant is above a threshold temperature; and to switchably admit the exhaust gas to the exhaust-gas recirculation cooler according to an EGR-cooler restoring control mode when a temperature of the coolant is below the threshold temperature, the EGR-cooler restoring control mode admitting a greater time-averaged flow of the exhaust gas through the exhaust-gas recirculation cooler when the temperature of the coolant is below the threshold temperature than does the normal-calibration control mode.

10. The system of claim 9, wherein the valve is among a plurality of valves actuated by the controller to switchably admit the exhaust gas to the exhaust-gas recirculation cooler at least when the temperature of the first coolant is below the threshold temperature.

11. The system of claim 9, wherein the exhaust-gas recirculation cooler includes a first heat exchanger configured to transmit heat from the exhaust gas to the first coolant over a first temperature range, and a second heat exchanger configured to transmit heat from the exhaust gas to a second coolant over a second temperature range lower than the first temperature range, wherein the first coolant is an engine coolant and the second coolant is an auxiliary coolant.

12. The system of claim 9, the controller further configured to switchably admit the exhaust gas to the exhaust-gas recirculation cooler according to an EGR-cooler restoring control mode immediately following or during a cold start of the engine.

13. The system of claim 9, the controller further configured, based on a control-mode schedule or sequence, to switchably admit the exhaust gas to the exhaust-gas recirculation cooler according to an EGR-cooler restoring control mode following some cold starts of the engine and according to the normal-calibration control mode following other cold starts of the engine.

14. The system of claim 13, wherein the controller is further configured to vary the control-mode schedule or sequence based on an accumulated run time of the engine.

15. A method for exhaust-gas recirculation (EGR) cooler bypass control comprising:

when cooler coolant temperature is above a threshold temperature, adjusting a cooler bypass to flow EGR through an EGR cooler according to a normal-calibration control mode;

when coolant temperature is below the threshold temperature, adjusting the cooler bypass to flow EGR through the EGR cooler according to an EGR-cooler restoring control mode admitting a greater time-averaged EGR flow than does the normal-calibration mode.

16. The method of claim 15, wherein the threshold temperature is a predicted exhaust gas dewpoint temperature.

17. The method of claim 16, further comprising adjusting the cooler bypass based on temperature of an exhaust after-treatment device.

* * * * *